US008465260B2

(12) United States Patent
Wu et al.

(10) Patent No.: US 8,465,260 B2
(45) Date of Patent: Jun. 18, 2013

(54) COMBINATION FAN PROPELLER STRUCTURE

(75) Inventors: Jen-Chieh Wu, Sinjhuang (TW); Chiang-Han Chen, Sinjhuang (TW)

(73) Assignee: Beijing AVC Technology Research Center Co., Ltd., Beijing (CN)

( * ) Notice: Subject to any disclaimer, the term of this patent is extended or adjusted under 35 U.S.C. 154(b) by 646 days.

(21) Appl. No.: 12/710,313

(22) Filed: Feb. 22, 2010

(65) Prior Publication Data

US 2011/0206520 A1 Aug. 25, 2011

(51) Int. Cl.
*F04D 29/34* (2006.01)

(52) U.S. Cl.
USPC ..... 416/204 R; 416/208; 416/234

(58) Field of Classification Search
USPC ..... 416/208, 234, 218, 204 R
See application file for complete search history.

(56) References Cited

U.S. PATENT DOCUMENTS

| | | | | |
|---|---|---|---|---|
| 1,864,492 | A * | 6/1932 | Krasnodmsky | 416/200 R |
| 6,506,019 | B2 * | 1/2003 | Lin et al. | 416/93 A |
| 6,540,479 | B2 * | 4/2003 | Liao et al. | 415/199.5 |
| 2005/0111985 | A1 * | 5/2005 | Chen et al. | 416/204 R |
| 2005/0271509 | A1 * | 12/2005 | Chang et al. | 416/204 R |
| 2009/0155080 | A1 * | 6/2009 | Yu | 416/212 R |
| 2009/0155081 | A1 * | 6/2009 | Yu | 416/219 R |
| 2011/0103957 | A1 * | 5/2011 | Tang et al. | 416/204 R |

* cited by examiner

*Primary Examiner* — Nathaniel Wiehe
*Assistant Examiner* — Aaron Jagoda

(57) ABSTRACT

A combination fan propeller structure including a hub and at least one first blade assembly. The hub includes a top section and an annular section extending from the top section. The annular section has a free end distal from the top section. The first blade assembly has at least one connection section for connecting with the free end to form the fan propeller structure.

10 Claims, 21 Drawing Sheets

COMBINATION FAN PROPELLER STRUCTURE

FIELD OF THE INVENTION

The present invention relates generally to a fan propeller structure, and more particularly to a combination fan propeller structure including a hub and at least one first blade assembly. Each first blade assembly has a connection section assembled with the hub. The first blade assemblies are arranged in an overlapping pattern, whereby the noise is effectively reduced and the wind power is greatly increased.

BACKGROUND OF THE INVENTION

Following the development of electronic industries, the performances of all kinds of electronic components have been rapidly promoted to have faster and faster processing speed. Also, an electronic component contains more and more chips therein. The chips work at high speed and generate high heat at the same time. The heat must be efficiently dissipated outward. Otherwise, the performances of the electronic component will be greatly affected to slow down the operation speed of the electronic component. In some serious cases, the electronic component may be burnt out due to overheating. Therefore, heat dissipation has become a critical topic for all kinds of electronic components. A cooling fan is often used as a heat dissipation device for electronic components.

The conventional cooling fans are generally divided into plastic-made fans and metal-made fans. In practice, the plastic-made cooling fans have lower durability than the metal-made cooling fans. For example, the blades of a plastic fan are subject to deformation and damage due to collision or compression. Therefore, metal cooling fans have been more and more widely developed by manufacturers.

FIGS. 1A and 1B are perspective exploded and perspective assembled views of a conventional metal-made fan propeller structure. The fan propeller structure includes a hub 10 and a blade assembly 12 having multiple blades 121 and a connection member 122. The blades 121 extend from a circumference of the connection member 122 to form the blade assembly 12. The blade assembly 12 is capped on the hub 10 with the connection member 122 and the blades 121 attaching to the top face and outer circumference of the hub 10 respectively. The blades 121 and the connection member 122 are fixedly point-welded on the top face and the outer circumference of the hub 10 respectively to form the fan propeller structure.

The above metal-made fan propeller structure is free from the problem of poor durability and is not so easy to damage as the plastic cooling fan. However, the metal-made cooling fan has otherwise problems. The blade assembly 12 is made with a press mold (not shown). The connection member 122 is first made by means of pressing. Then the blades 121 are continuously formed by means of pressing. When pressing the blade assembly 12, intervals must be reserved between the blades 121 for pressing the blades 121. Due to the reserved intervals, it is impossible to press the blades with the mold in an overlapping pattern. As a result, the wind power of the fan propeller is unsatisfying and in operation, the fan propeller is likely to make noise.

Also, when assembling the blade assembly 12 with the hub 10, the blade assembly 12 is capped onto the hub 10 with the connection member 122 and the blades 121 attaching to the top face and the outer circumference of the hub 10 respectively. Thereafter, the blades 121 and the connection member 122 are point-welded on the top face and the outer circumference of the hub 10. However, when point-welded, the blade assembly 12 is simply attached to the hub 10 without being located thereon. Therefore, during the point-welding process, the blade assembly 12 and the hub 10 tend to displace from each other. As a result, the blades 121 can be hardly fixed in their true positions. In this case, the blades 121 will produce turbulent airflow to cause wind resistance. Consequently, the wind power of the fan propeller will be deteriorated.

According to the aforesaid, the conventional fan propeller structure has the following shortcomings:

1. The wind power of the conventional fan propeller structure is low.
2. It is impossible to manufacture the blades in an overlapping pattern.
3. It is hard to manufacture the conventional fan propeller structure.
4. In operation, the fan propeller is likely to make noise.

SUMMARY OF THE INVENTION

A primary object of the present invention is to provide a combination fan propeller structure including a hub and at least one first blade assembly assembled therewith. The first blade assemblies are arranged in an overlapping pattern to greatly increase wind power of the fan propeller structure.

A further object of the present invention is to provide the above combination fan propeller structure, in which the blades can be more conveniently replaced.

A still further object of the present invention is to provide the above combination fan propeller structure, in which the noise produced in operation is reduced.

To achieve the above and other objects, the combination fan propeller structure of the present invention includes a hub and at least one first blade assembly. The hub includes a top section and an annular section extending from the top section. The annular section has a free end distal from the top section. The first blade assembly has at least one connection section for connecting with the free end to form the fan propeller structure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
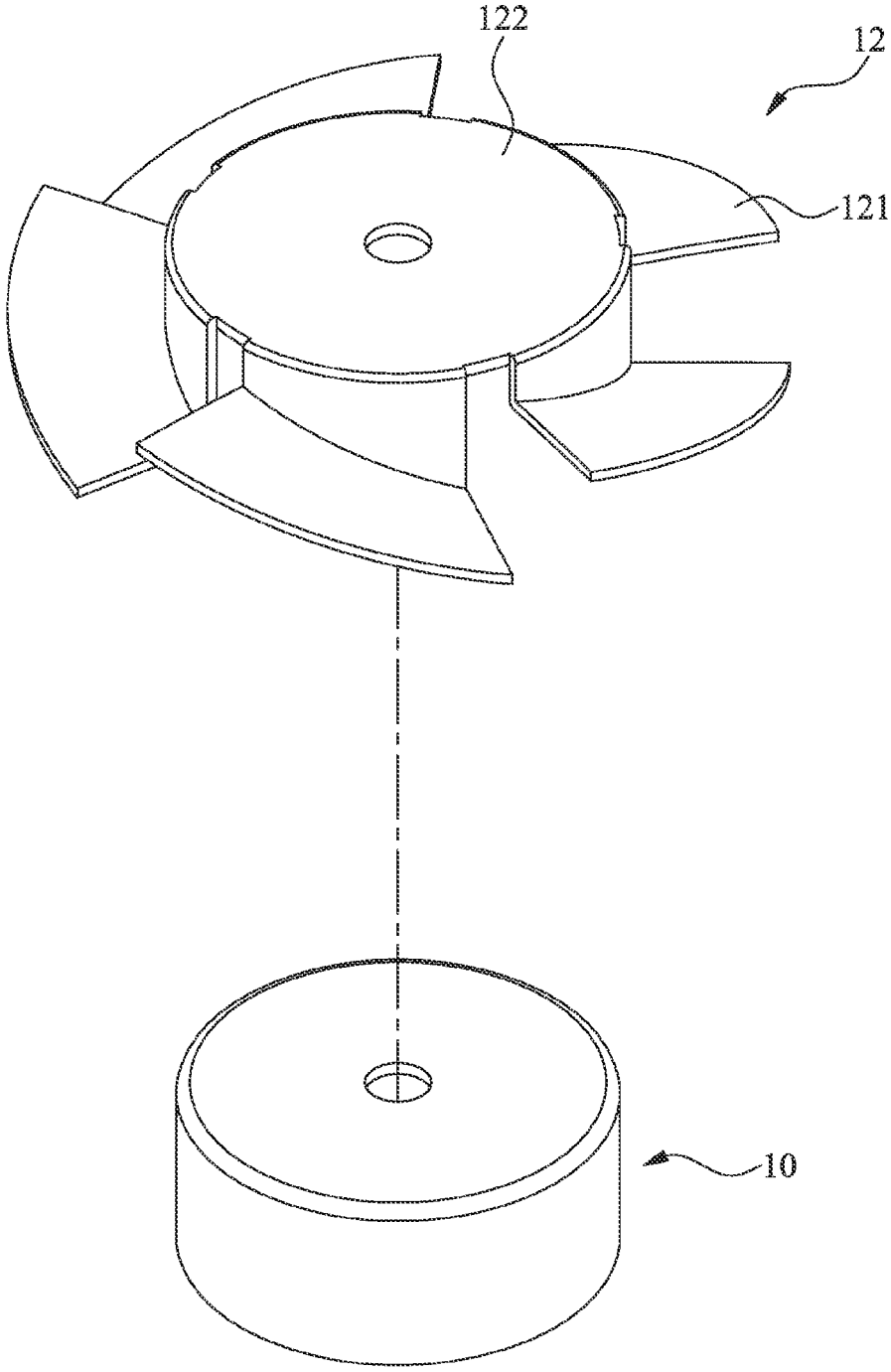
Fig. 1A(PRIOR ART)
FIG. 1A is a perspective exploded view of a conventional fan propeller structure.
Figure 1B:
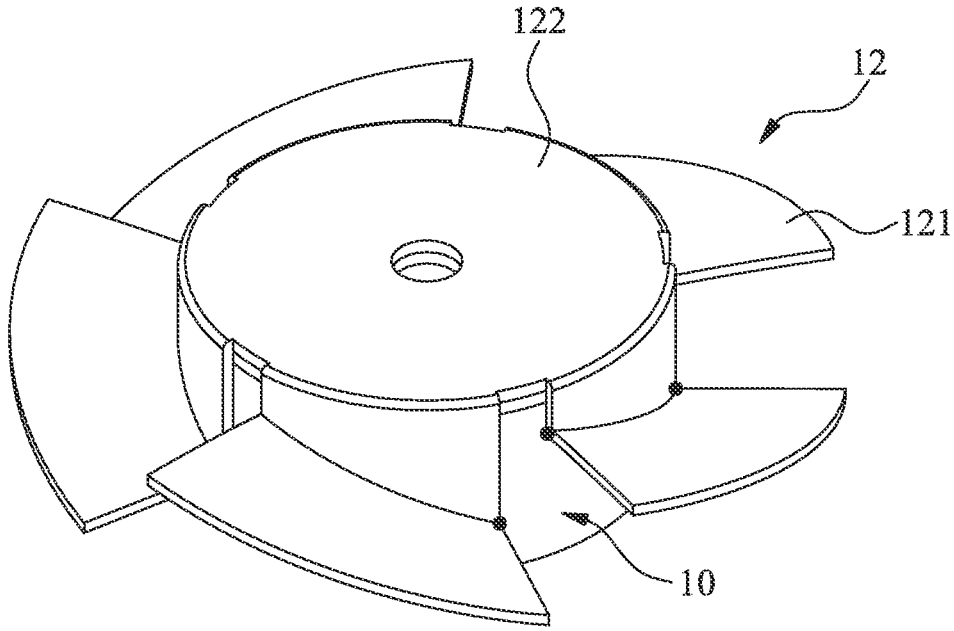
Fig. 1B(PRIOR ART)
FIG. 1B is a perspective assembled view of the conventional fan propeller structure.
Figure 2:
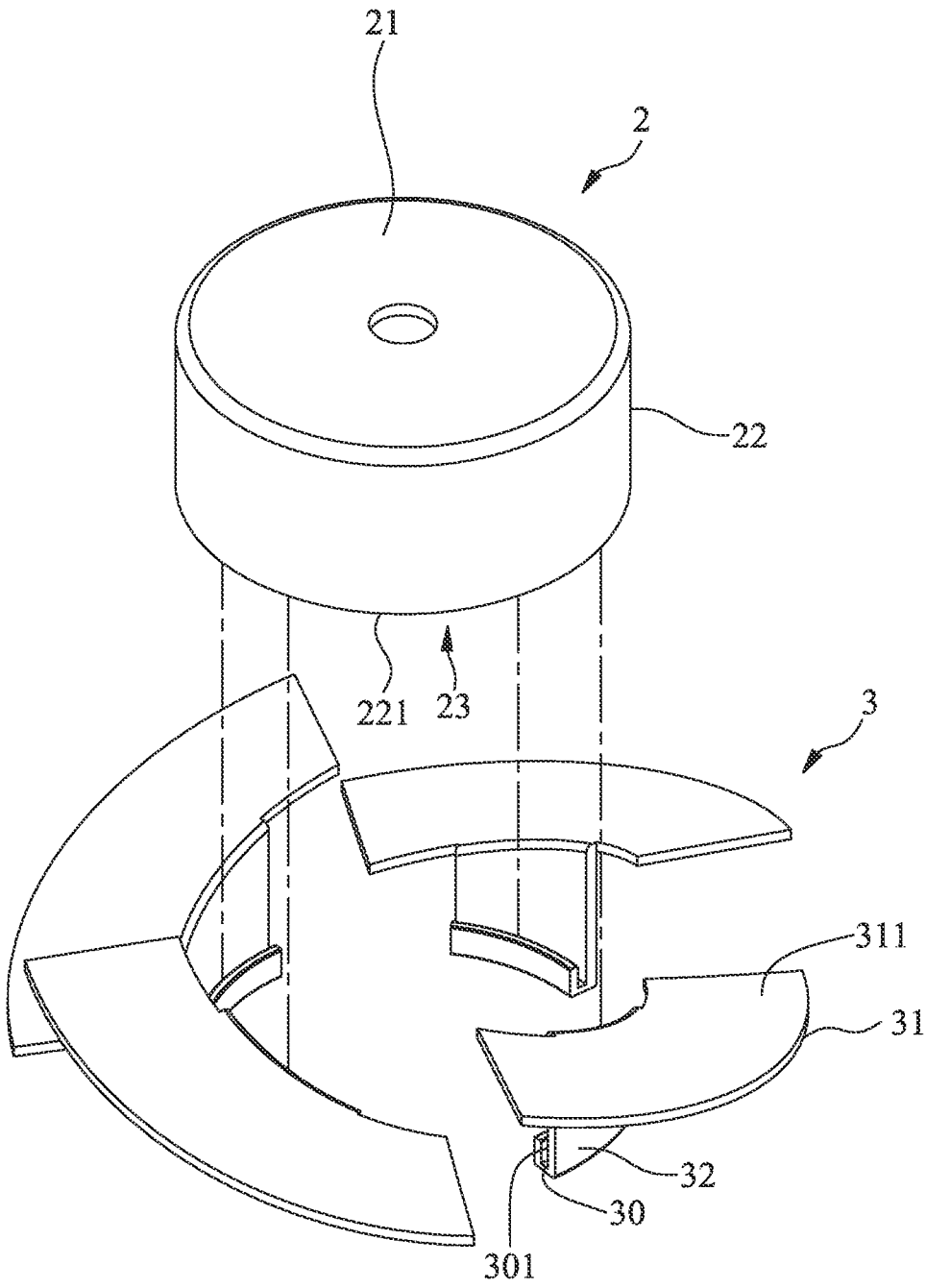
FIG. 2 is a perspective exploded view of a first embodiment of the present invention.
Figure 3:
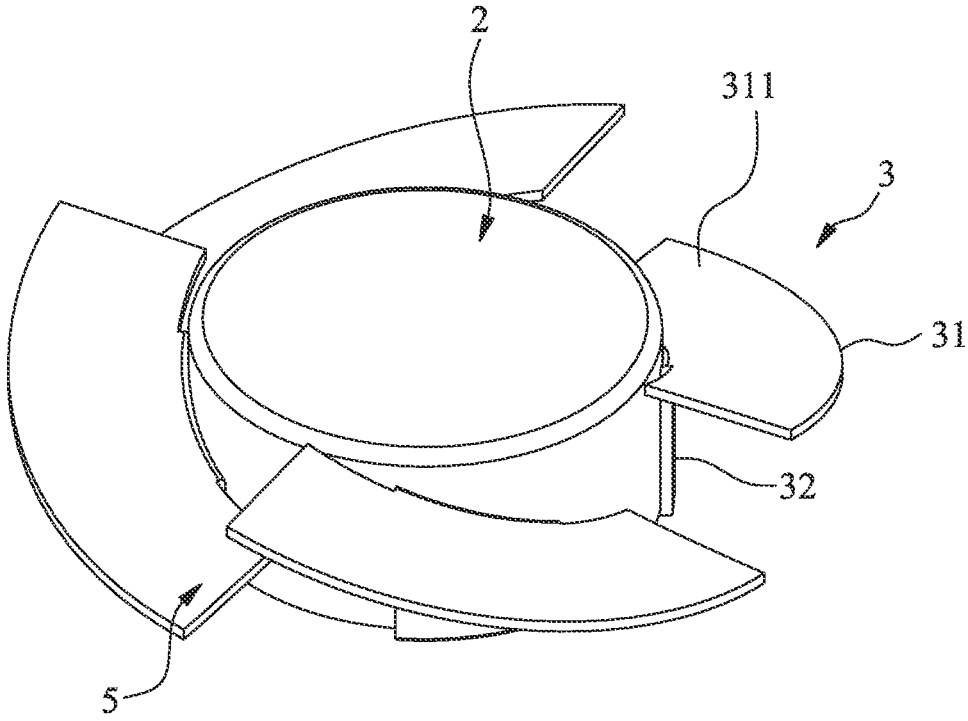
FIG. 3 is a perspective assembled view of the first embodiment of the present invention.
Figure 4:
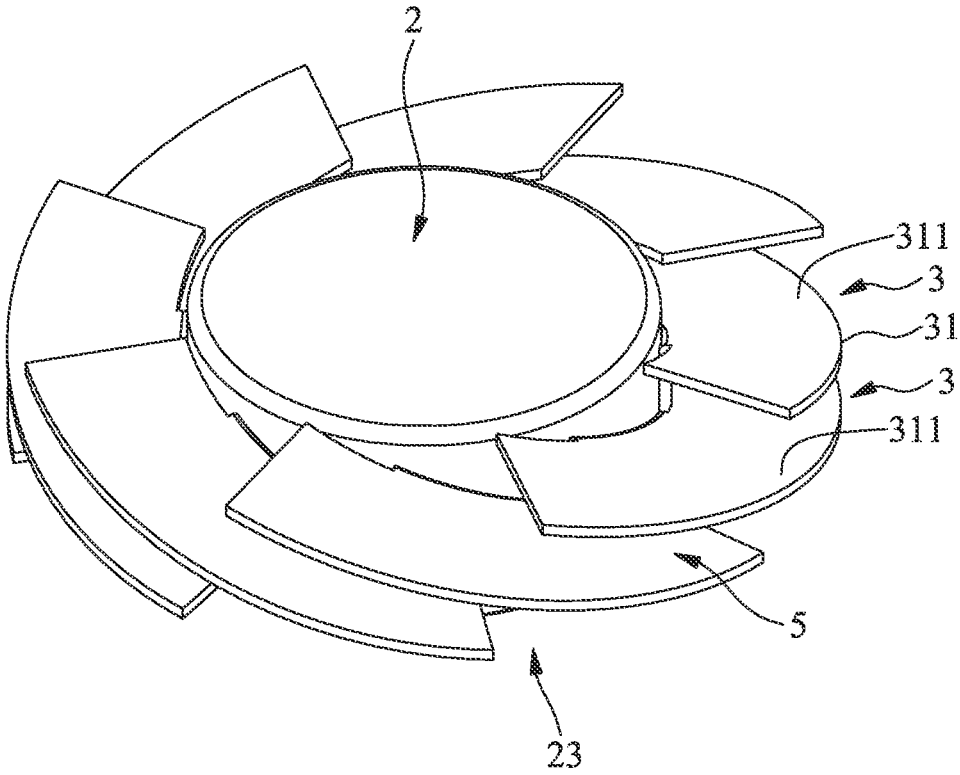
FIG. 4 is another perspective assembled view of the first embodiment of the present invention.

Please refer to FIGS. 2, 3 and 4. According to a first embodiment, the combination fan propeller structure of the present invention includes a hub 2 and at least one first blade assembly 3. The hub 2 includes a top section 21 and an annular section 22 extending from the top section 21. The annular section 22 has a first end connected with a periphery of the top section 21 and a second end distal from the periphery of the top section 21 as a free end 221. The annular section 22 and the top section 21 together define a receiving space 23 in which a shaft seat of a frame body (not shown) is enclosed.

The first blade assembly 3 has at least one connection section 30 for connecting with the free end 221 to form the fan propeller structure. In other words, the connection section 30 of the first blade assembly 3 is connected and assembled with the free end 221 of the annular section 22 to form the fan propeller structure. Multiple first blade assemblies 3 can be successively assembled with the hub 2 in an overlapping pattern, whereby the fan propeller structure has overlapping blades.

In other words, the adjacent first blade assemblies 3 are positioned at different heights in an overlapping pattern. Each two adjacent first blade assemblies 3 define therebetween a flow way 5 for guiding airflow. The connection section 30 can be complementarily connected with the free end 221 by way of insertion, engagement, adhesion, tight fit or the like. The hub 2 and the first blade assembly 3 are made of metal material such as iron, aluminum or copper or a metal alloy.

Please now refer to FIGS. 2, 3 and 4. The first blade assembly 3 includes a first wind guide section 31 and a first extension section 32. The first wind guide section 31 has two faces as two first wind guide faces 311. The first wind guide faces 311 of each two adjacent first wind guide sections 31 are positioned at different heights in an overlapping pattern. The first extension section 32 extends from the first wind guide section 31 to connect with the connection section 30 and conformably attach to the annular section 22. In other words, the connection section 30 is complementarily fixedly connected with the free end 221 of the annular section 22 by way of insertion (or engagement). At this time, one side of the first extension section 32 attaches to the circumference of the annular section 22. In addition, the first wind guide sections 31 overlap each other. In this case, in operation, the wind power of the fan propeller is greatly promoted and the noise is reduced.

Figure 5:
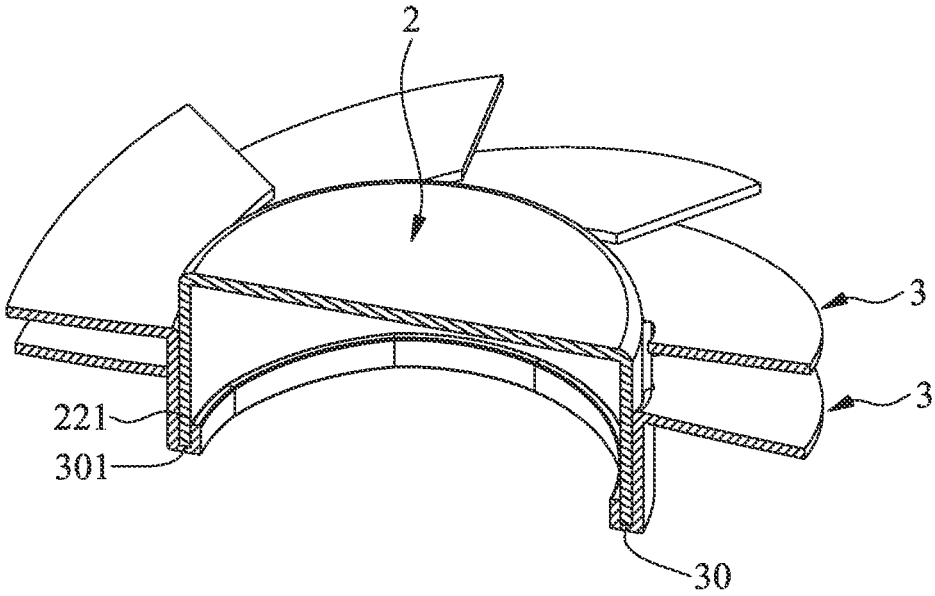
FIG. 5 is a sectional assembled view of the first embodiment of the present invention in an aspect.

Please further refer to FIGS. 2 to 8. The connection section 30 has a channel 301 in which the free end 221 can be conformably inserted and received. The free end 221 has at least one protrusion 222 corresponding to the connection section 30. The protrusion 222 extends from the free end 221 in a direction away from the periphery of the top section 21. The protrusion 222 is inserted in the corresponding channel 301 of the connection section 30. In this embodiment, the connection section 30 of the first blade assembly 3 can be assembled with the free end 221 of the annular section 22 in four aspects. According to the first aspect, the connection section 30 has a U-shaped channel 301. The free end 221 has a configuration identical to that of the channel 301. The free end 221 is moved in a direction to the channel 301 to be engaged therein (as shown in FIG. 5).

Figure 6A:
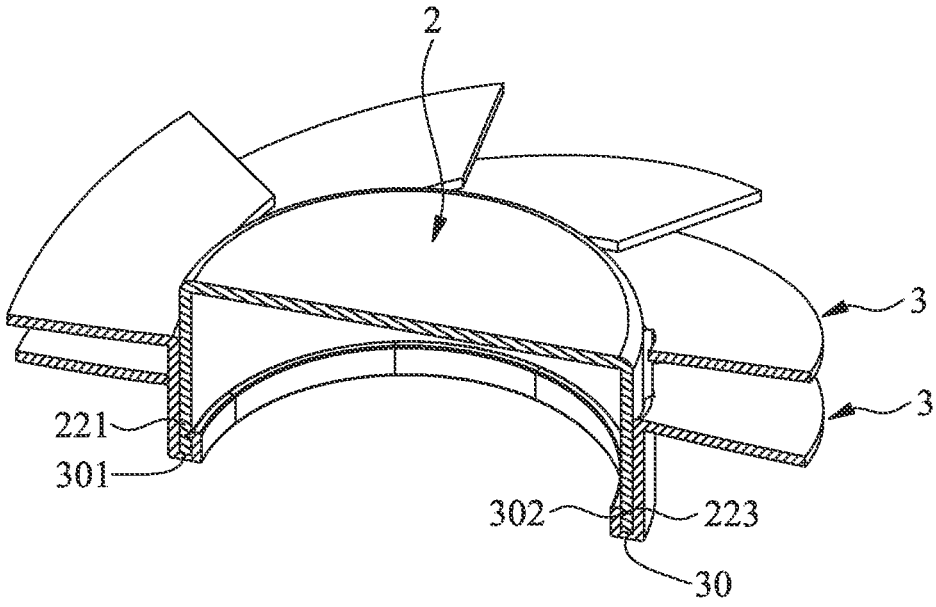
FIG. 6A is a sectional assembled view of the first embodiment of the present invention in another aspect.
Figure 6B:
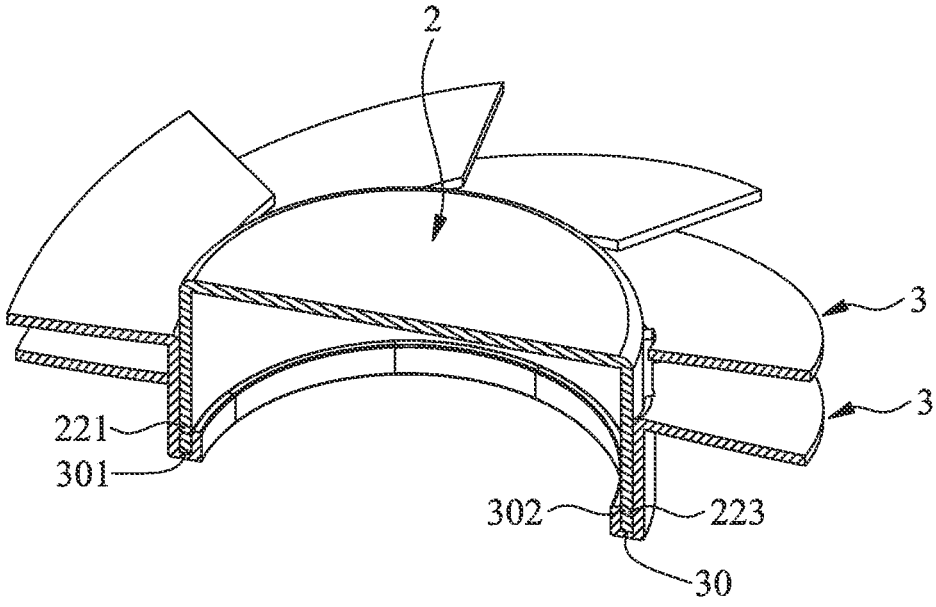
FIG. 6B is a sectional assembled view of the first embodiment of the present invention in another aspect.
Figure 6C:
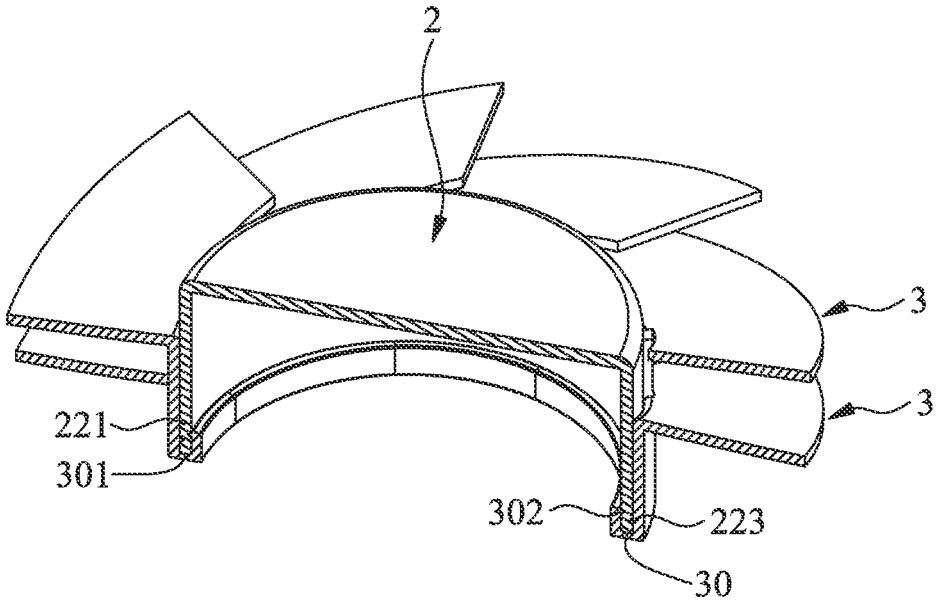
FIG. 6C is a sectional assembled view of the first embodiment of the present invention in another aspect.
Figure 6D:
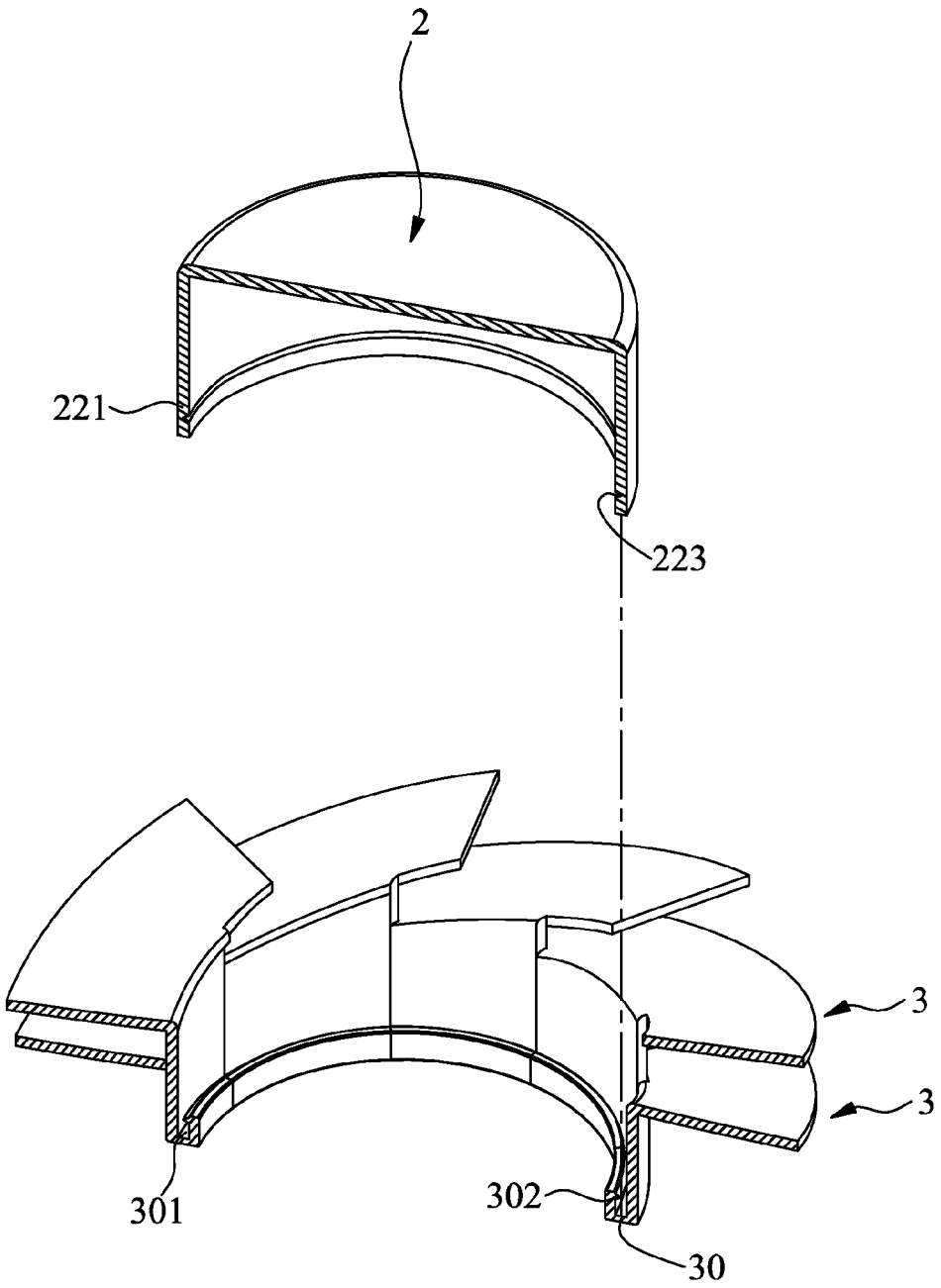
Figure 6E:
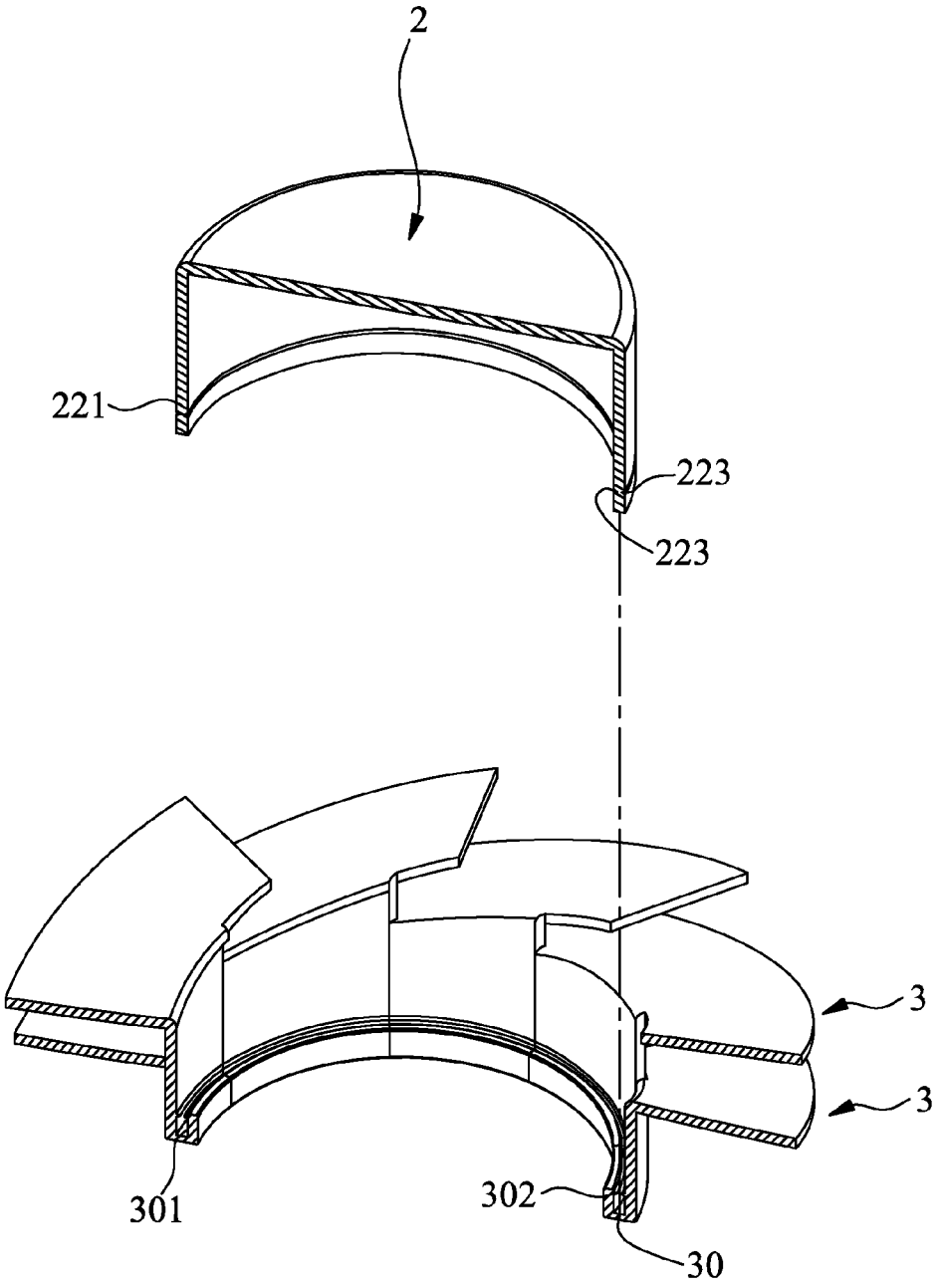
Figure 6F:
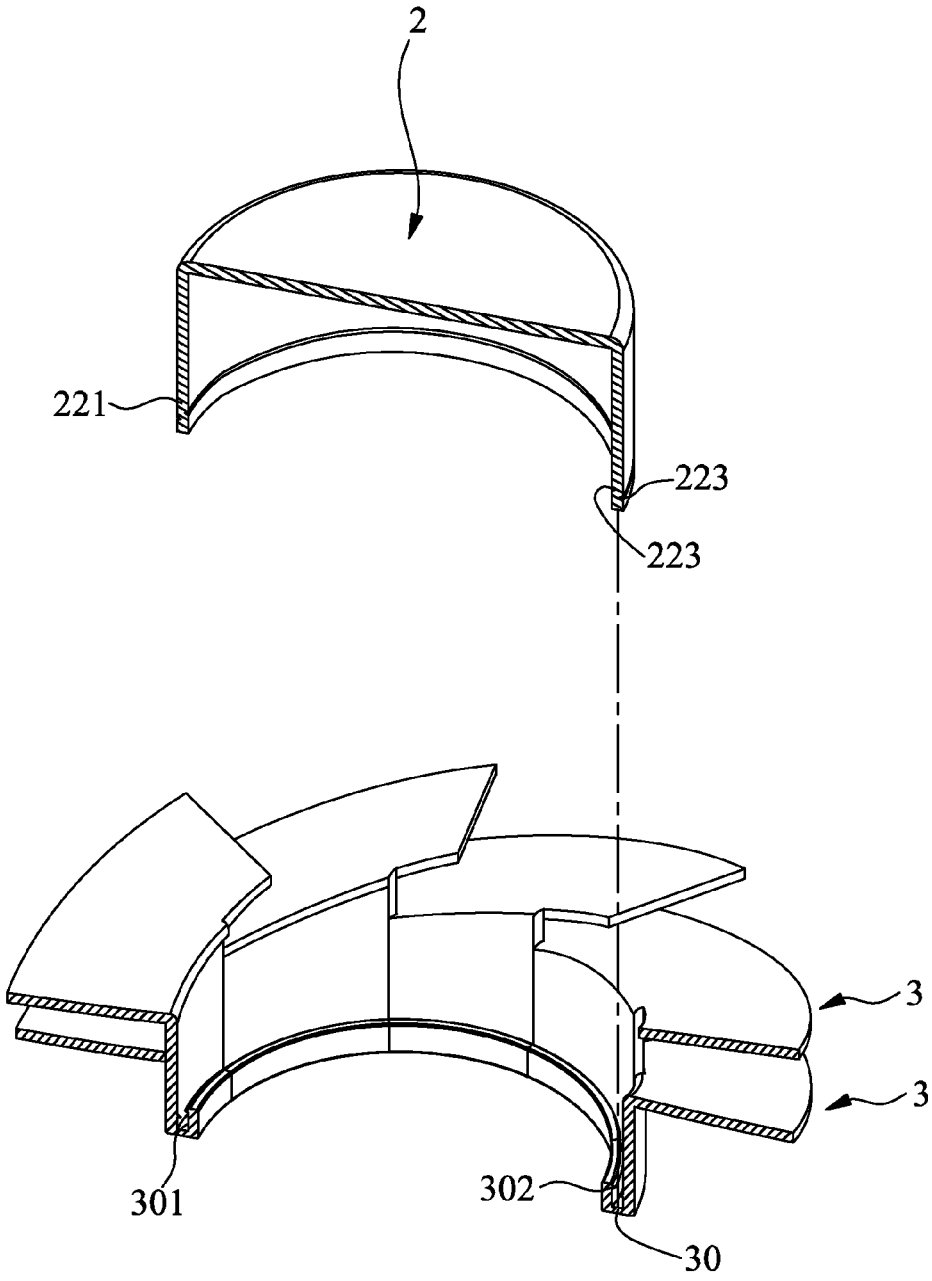

Please now refer to FIGS. 4, 6A, 6B, 6C, 7 and 8. According to the second aspect, the channel 301 of the connection section 30 has at least one protrusion 302. The protrusion 302 extends from inner side of the channel 301 toward the center thereof for abutting against and fixing the free end 221. The free end 221 has at least one fixing hole 223 formed on inner circumference of the annular section 22 in adjacency to the free end 221. The number of the fixing holes 223 is exactly equal to that of the protrusions 302 of the channel 301. When the free end 221 is moved toward the channel 301 and connected therewith, the protrusions 302 of the channel 301 are fixedly inlaid in the fixing holes 223 of the free end 221. The protrusions 302 can be symmetrically arranged on inner side of the channel 301 (as shown in FIG. 6B) or asymmetrically arranged on the inner side of the channel 301 (as shown in FIG. 6C).

Figure 7:
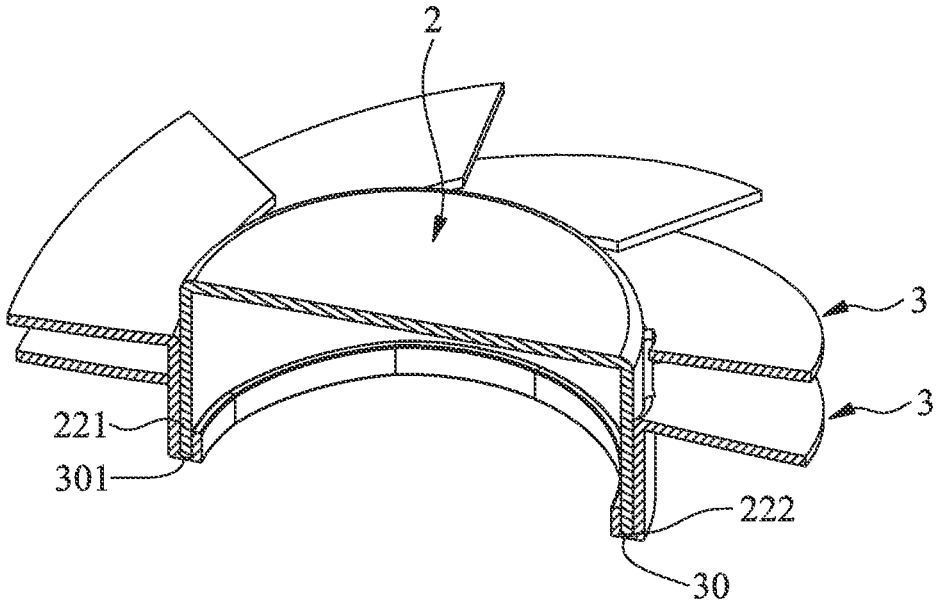
FIG. 7 is a sectional assembled view of the first embodiment of the present invention in another aspect.
Figure 8:
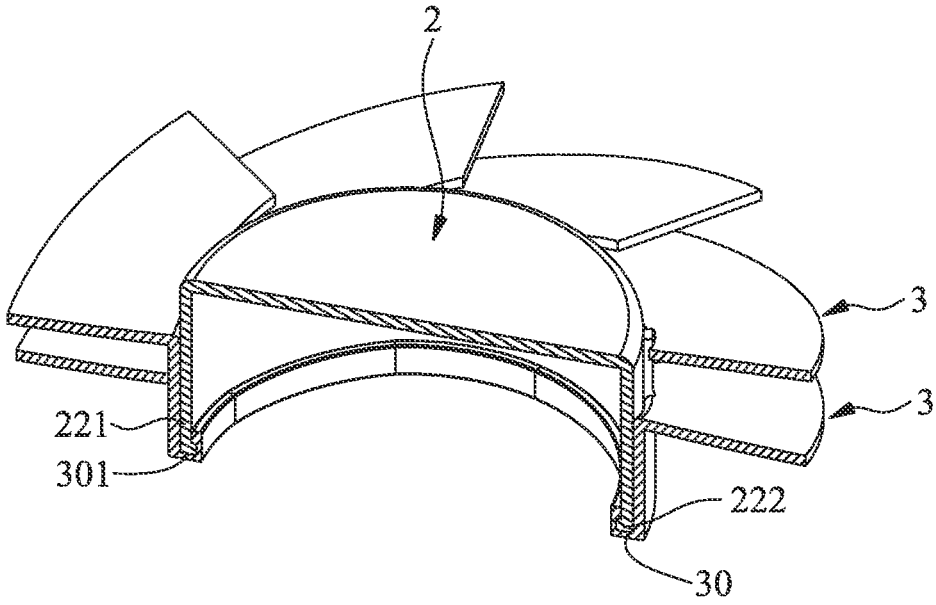
FIG. 8 is a sectional assembled view of the first embodiment of the present invention in another aspect.

According to the third aspect, the bottom of the channel 301 of the connection section 30 is substantially elliptically shaped. The free end 221 has a substantially elliptically shaped protrusion 222 and is moved into the channel 301 until the free end 221 is inserted in the channel 301. At this time, the elliptically shaped protrusion 222 is snugly tightly inlaid in the elliptically shaped channel 301 (as shown in FIG. 7). According to the fourth aspect, the connection section 30 is a substantially hook-shaped channel 301, while the free end 221 has a substantially L-shaped protrusion 222. When the protrusion 222 is connected to the channel 301, the front end section of the protrusion 222 is first inserted into the bending portion of the hook-shaped channel 301. Then the protrusion 222 of the free end 221 is forced into the channel 301 of the connection section 30. At this time, the rear section of the protrusion 222 abuts against the bottom of the channel 301. In this case, the protrusion 222 of the free end 221 is fixedly engaged and received in the channel 301 of the connection section 30 (as shown in FIG. 8).

According to the aforesaid, when assembling the fan propeller, the first blade assembly 3 is forced to move toward the free end 221 of the annular section 22, whereby the connection section 30 of the first blade assembly 3 is connected with the free end 221 by means of insertion (engagement). The adjacent first blade assemblies 3 overlap each other so that the fan propeller has overlapping blades. Accordingly, the wind power of the fan propeller is greatly promoted and the noise produced in operation of the fan propeller is reduced. Moreover, it is more convenient to assemble and replace the blades.

Figure 9:
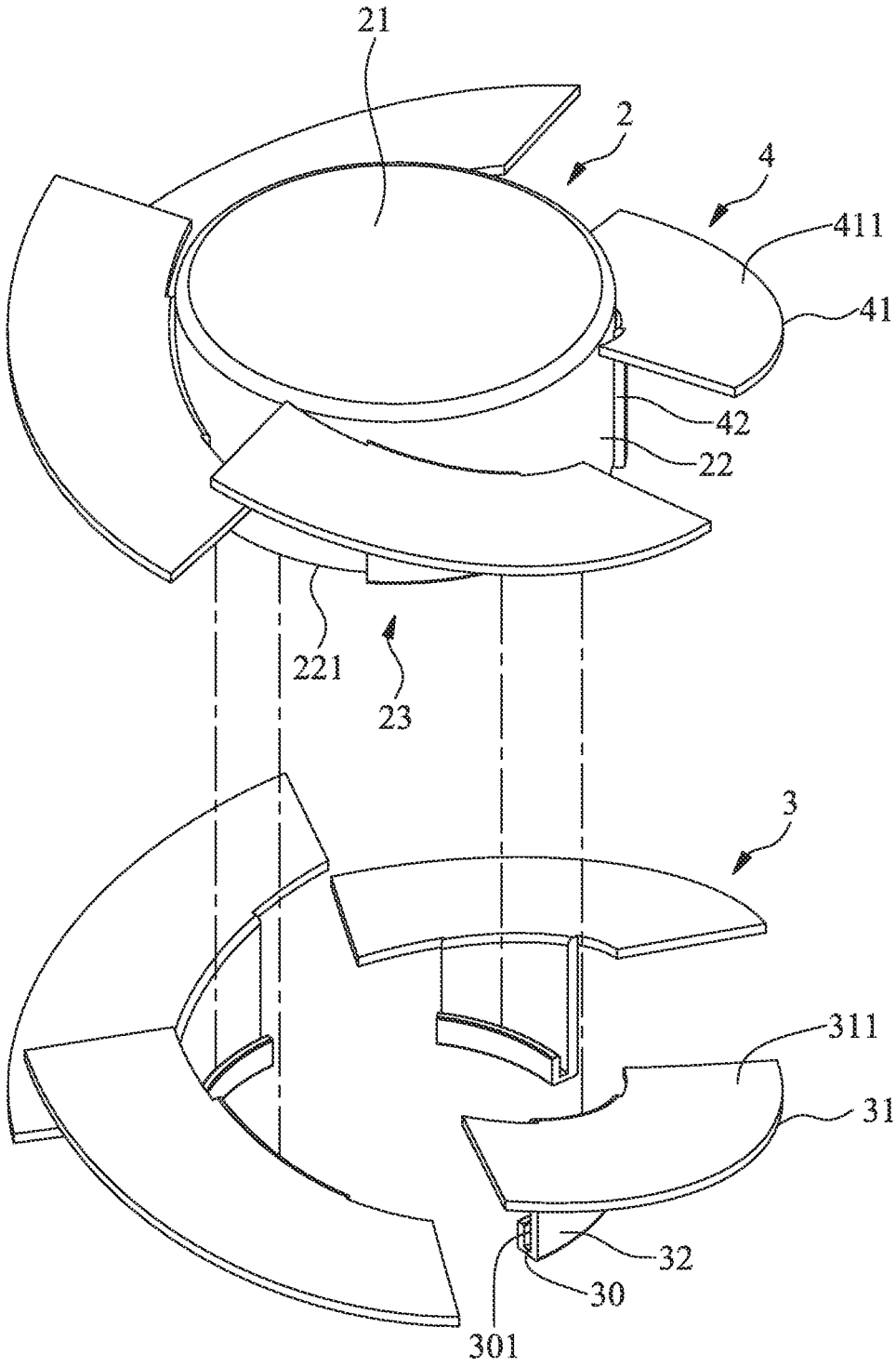
FIG. 9 is a perspective exploded view of a second embodiment of the present invention.
Figure 10:
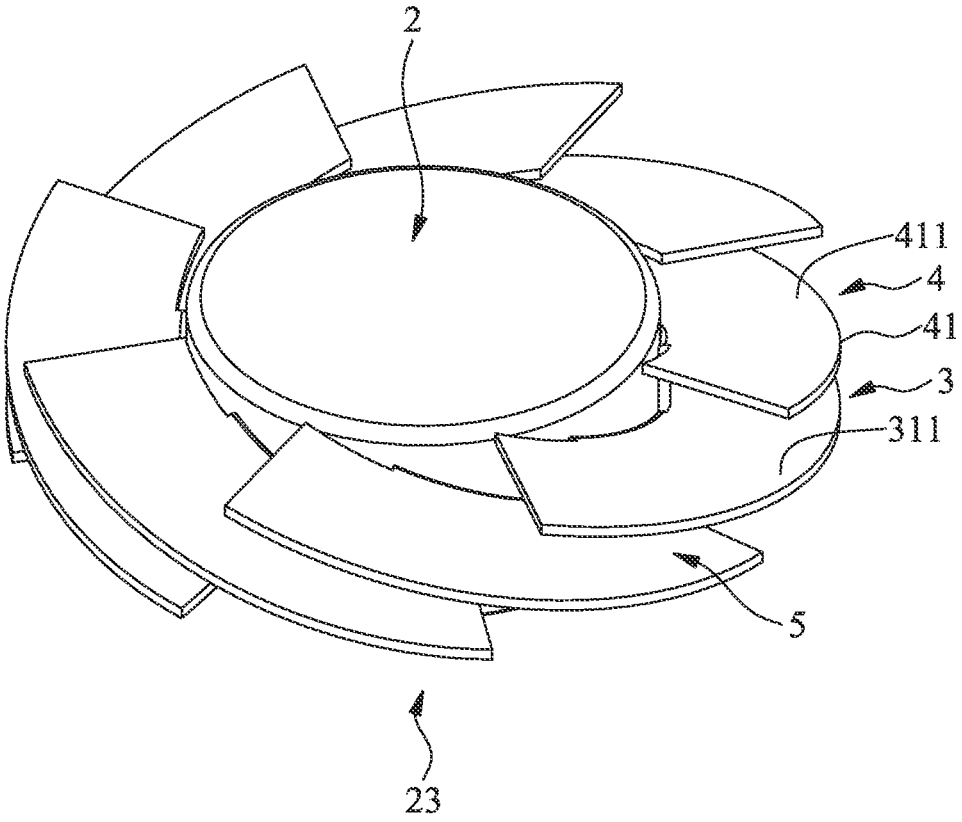
FIG. 10 is a perspective assembled view of the second embodiment of the present invention.
Figure 11:
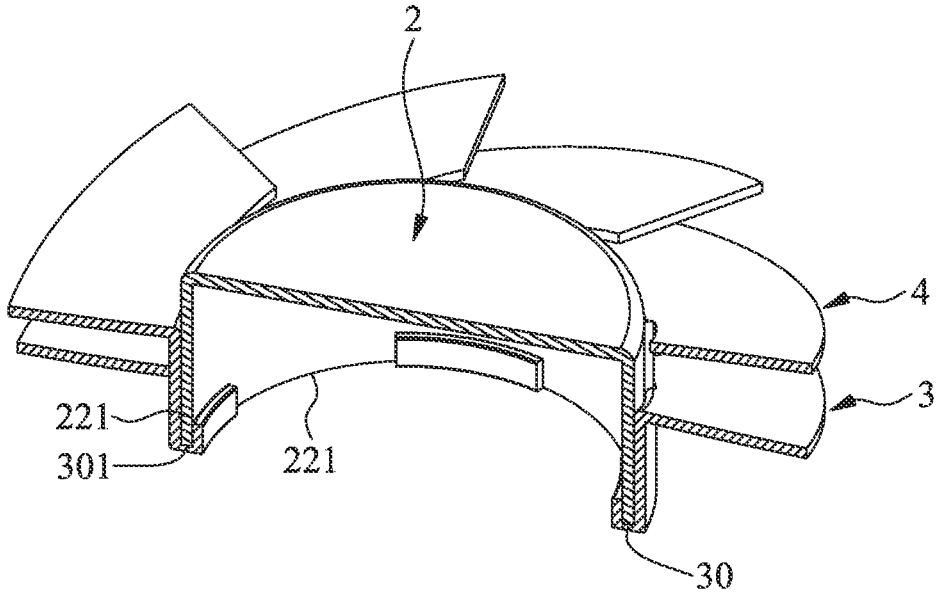
FIG. 11 is a sectional assembled view of the second embodiment of the present invention in an aspect.
Figure 12A:
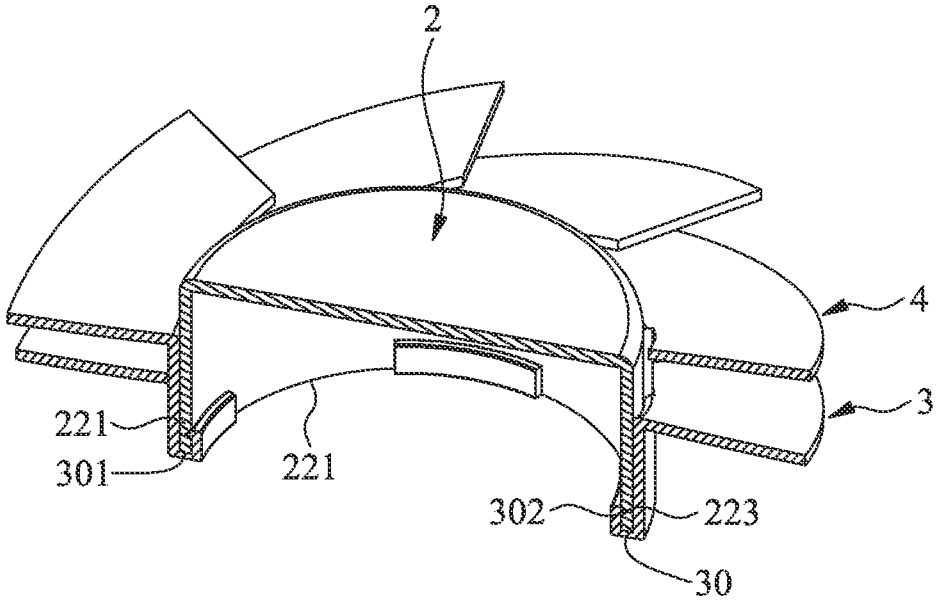
FIG. 12A is a sectional assembled view of the second embodiment of the present invention in another aspect.
Figure 12B:
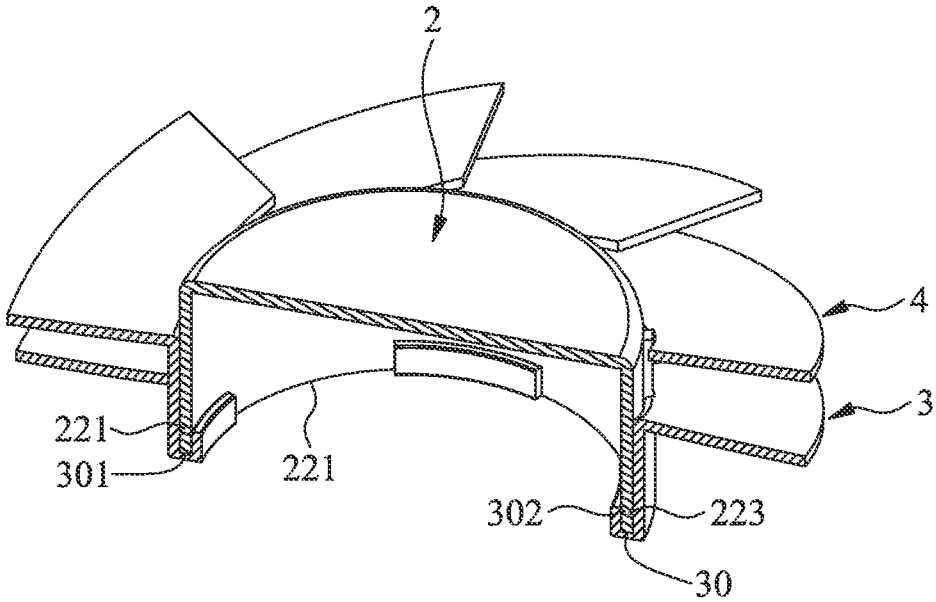
FIG. 12B is a sectional assembled view of the second embodiment of the present invention in another aspect.
Figure 12C:
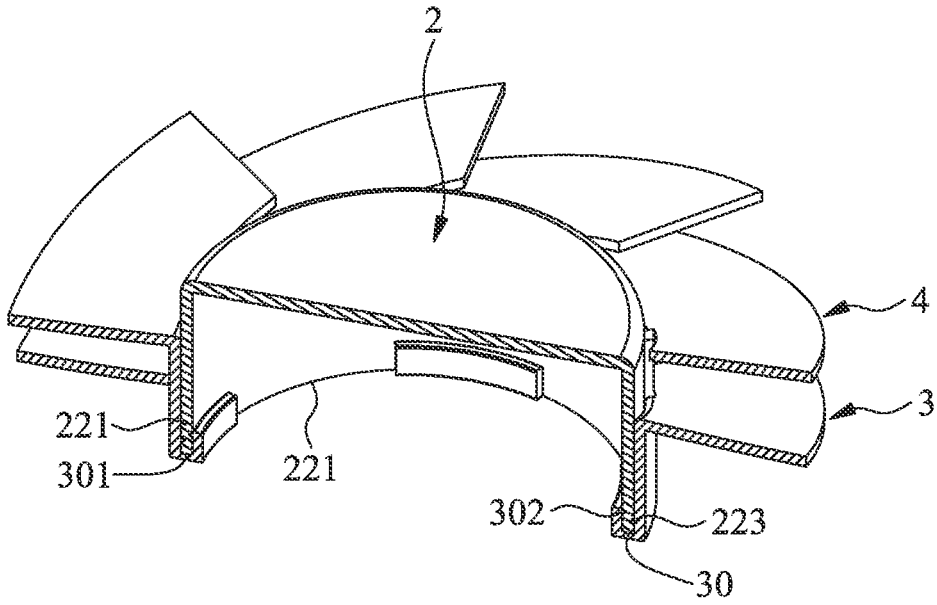
FIG. 12C is a sectional assembled view of the second embodiment of the present invention in another aspect.
Figure 12D:
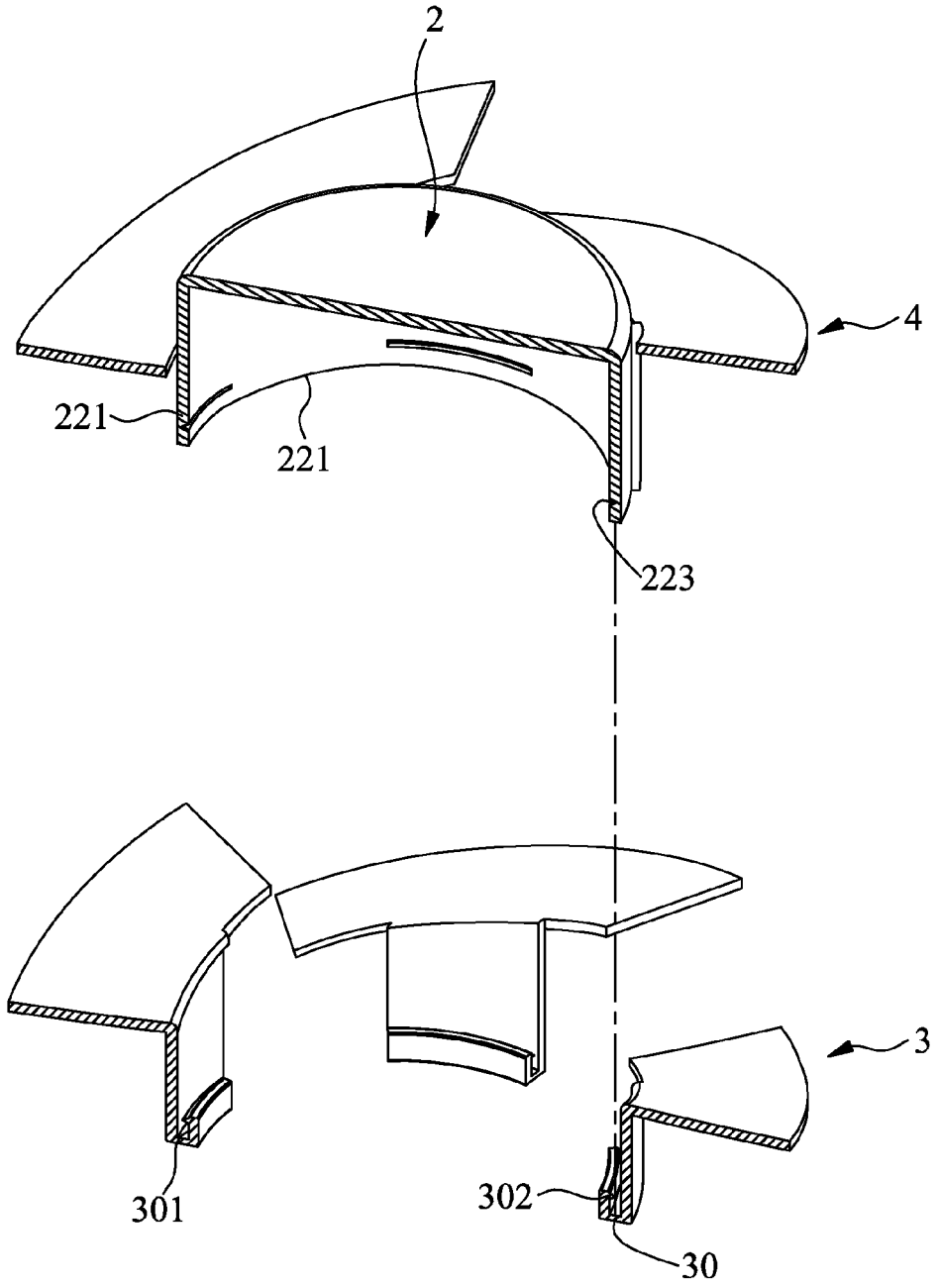
Figure 12E:
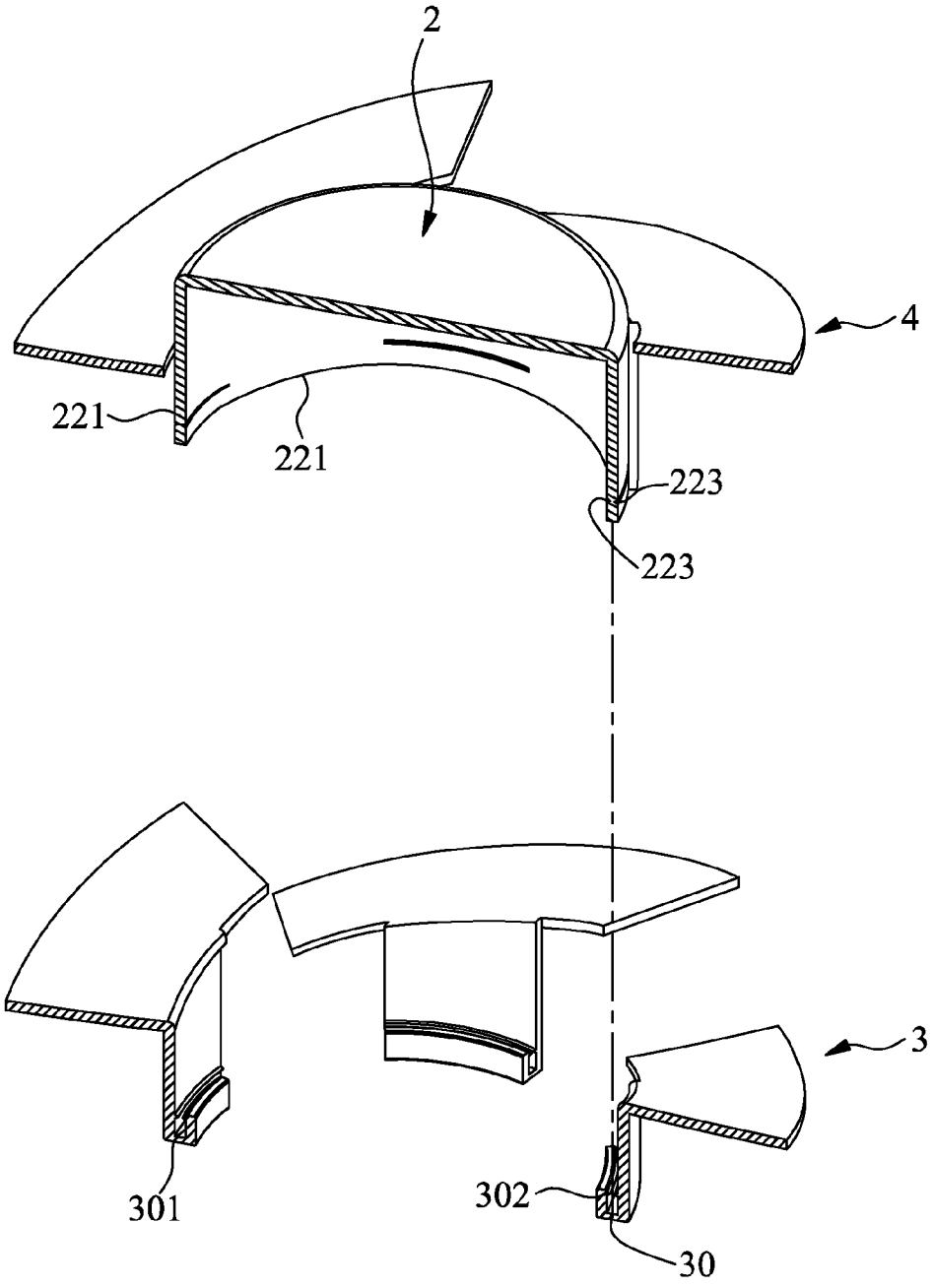
Figure 12F:
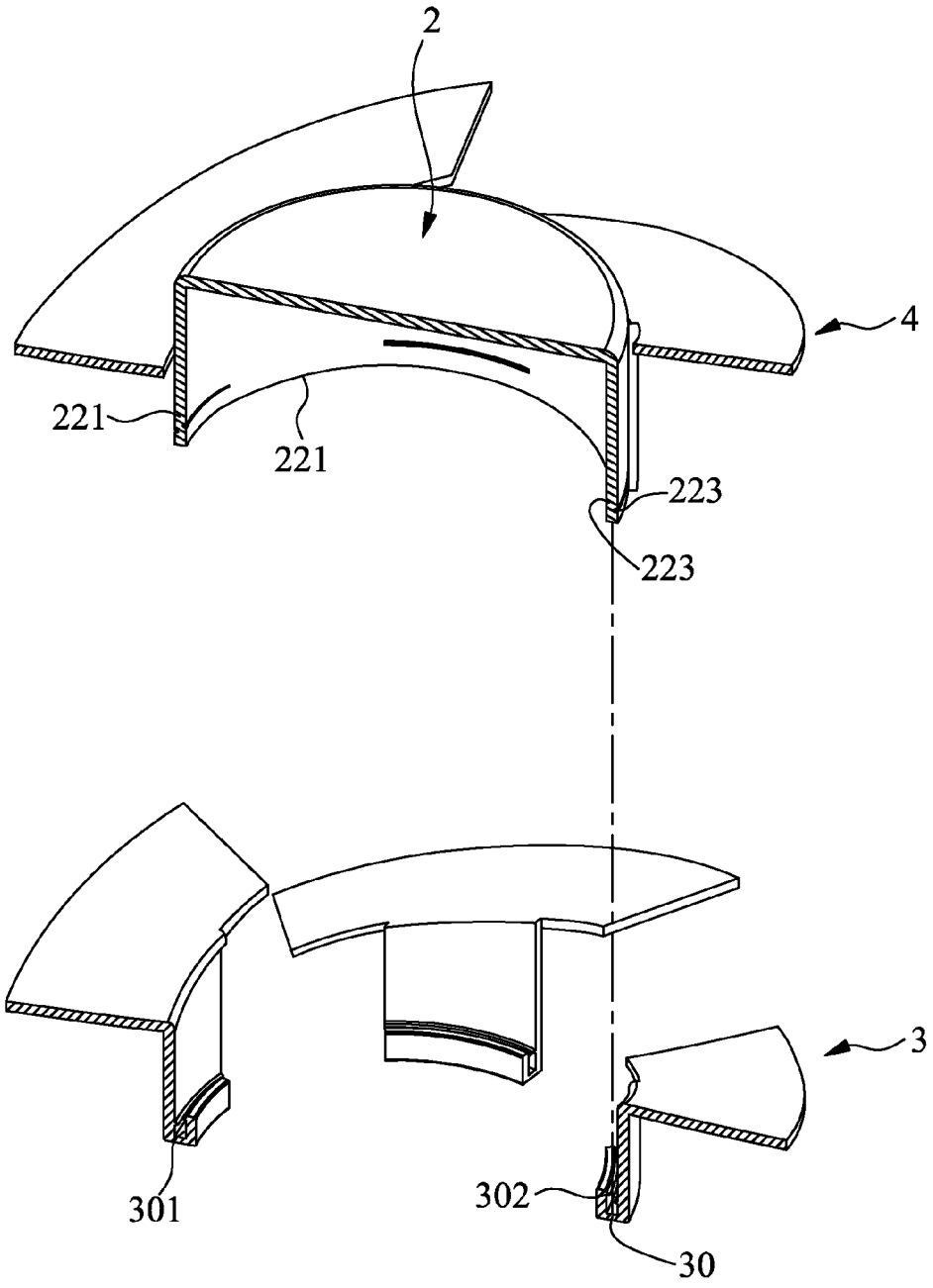
Figure 13:
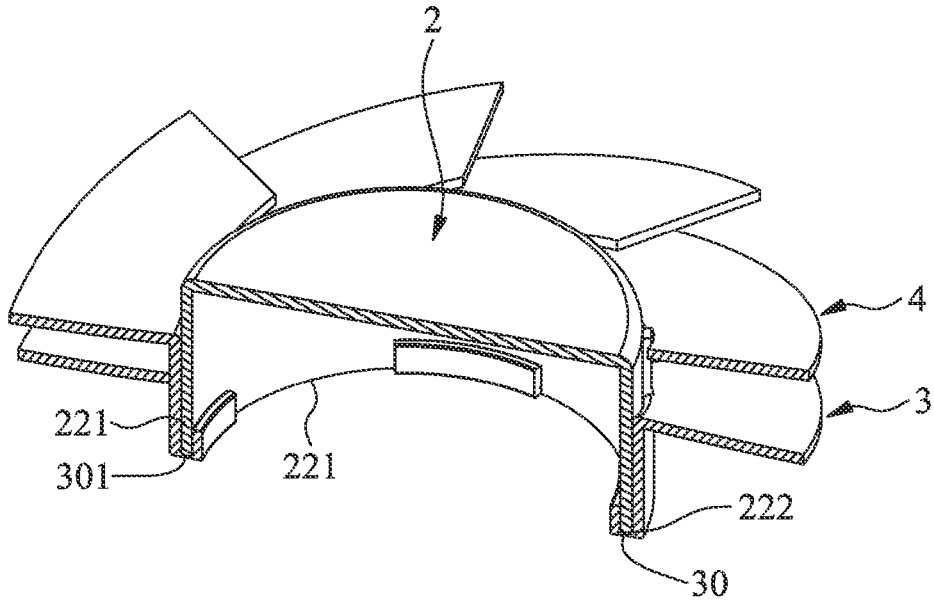
FIG. 13 is a sectional assembled view of the second embodiment of the present invention in another aspect.
Figure 14:
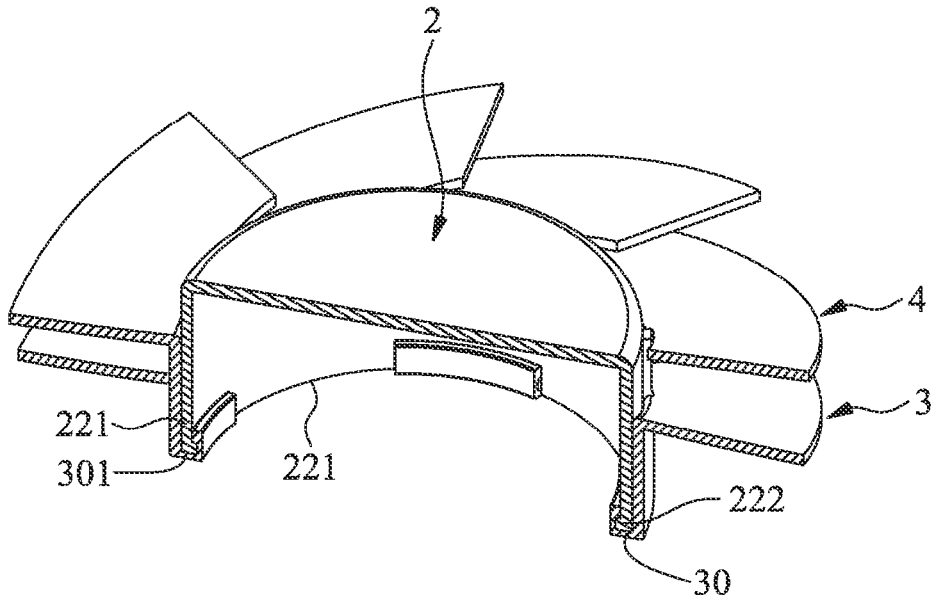
FIG. 14 is a sectional assembled view of the second embodiment of the present invention in another aspect.

FIGS. 9 and 10 show a second embodiment of the present invention, which is substantially identical to the first embodiment in structure and connection relationship between components. Therefore, these will not be repeatedly described hereinafter. The second embodiment is different from the first embodiment in that the hub 2 further includes multiple second blade assemblies 4. The second blade assemblies 4 extend from the free end 221 to surround the annular section 22. In other words, the second blade assemblies 4 extend from the free end 221 of the annular section 22 and are arranged around the circumference of the annular section 22 at equal intervals. The first blade assembly 3 is disposed between each two adjacent second blade assemblies 4 to overlap the second blade assemblies 4. That is, the connection section 30 of the first blade assembly 3 is connected with the free end 221 of the annular section 22 between the adjacent second blade assembles 4. Accordingly, the second and first blade assemblies 4, 3 are alternately arranged in an overlapping pattern.

In addition, the adjacent second and first blade assemblies 4, 3 define therebetween a flow way 5 for guiding airflow. The hub 2 and the first and second blade assemblies 3, 4 are made of metal material such as iron, aluminum or copper or a metal alloy.

Referring to FIGS. 9 and 10, the second blade assembly 4 includes a second wind guide section 41 and a second extension section 42. The second wind guide section 41 has two faces as two second wind guide faces 411. The second wind guide faces 411 and the adjacent first wind guide faces 311 are positioned at different heights in an overlapping pattern. The second extension section 42 extends from the free end 221 to connect with the second wind guide section 41 and conformably attach to the annular section 22. That is, one side of the second extension section 42 attaches to the circumference of the annular section 22. One side of the second wind guide face 411 is adjacent to the circumference of the annular section 22. In addition, one side of the second extension section 42 tightly abuts against one side of the adjacent first extension section 32, whereby the first and second wind guide sections 31, 41 overlap each other. In this case, in operation, the wind power of the fan propeller is greatly promoted and the noise is reduced.

Please further refer to FIGS. 9 to 14. In this embodiment, the connection section 30 of the first blade assembly 3 is assembled with the free end 221 of the annular section 22 in the same manner as the first embodiment. In practice, the first blade assembly 3 is applied to and connected with the conventional fan propeller structure in an overlapping pattern. In this case, on one hand the wind power of the conventional fan propeller structure is promoted and on the other hand it is more convenient to replace the blades and use the fan propeller structure.

When assembling the fan propeller, the first blade assembly 3 is forced to move toward the free end 221 of the annular section 22 between each two adjacent second blade assemblies 4. The connection section 30 of the first blade assembly 3 is connected with the free end 221 by means of insertion (engagement). In this case, the first and second blade assemblies 3, 4 are positioned in an overlapping pattern so that the fan propeller has overlapping blades. Accordingly, the wind power of the fan propeller is greatly promoted and the noise produced in operation of the fan propeller is reduced. Moreover, it is more convenient to assemble and replace the blades.

According to the aforesaid, the combination fan propeller structure of the present invention has the following advantages:

1. The noise is reduced and the wind power is enhanced.
2. It is more convenient to replace the blades.
3. The fan propeller has overlapping blades.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A combination fan propeller structure comprising:

a hub including a top section and an annular section extending from the top section, the annular section having a free end distal from the top section; and at least one first blade assembly having at least one connection section, the connection section having a U-shaped channel in which the free end is complementarily inserted and received, wherein inner sides of the channel are complementarily fixedly connected with inner and outer sides of the free end for connecting with the free end to integrate the hub.

2. The combination fan propeller structure as claimed in claim 1, wherein the first blade assembly includes a first wind guide section and a first extension section, the first extension section extending from the first wind guide section to connect with the connection section and conformably attach to the annular section.

3. The combination fan propeller structure as claimed in claim 2, wherein the first wind guide section has two faces as two first wind guide faces, the first wind guide faces of each two adjacent first wind guide sections being positioned at different heights in an overlapping pattern.

4. The combination fan propeller structure as claimed in claim 1, wherein the free end has at least one protrusion corresponding to the connection section for connecting with the connection section by means of insertion.

5. The combination fan propeller structure as claimed in claim 1, wherein the channel has at least one protrusion extending from an inner side of the channel toward a center thereof for abutting against and fixing the free end.

6. The combination fan propeller structure as claimed in claim 5, wherein the protrusions are symmetrically or asymmetrically arranged on an inner side of the channel.

7. The combination fan propeller structure as claimed in claim 6, wherein the free end has at least one fixing hole formed on an inner circumference of the annular section, the protrusion of the channel being complementarily fixedly inserted in the fixing hole.

8. The combination fan propeller structure as claimed in claim 1, wherein the connection section is complementarily connected with the free end by way of engagement, adhesion, insertion or tight fit.

9. The combination fan propeller structure as claimed in claim 1, wherein the hub further includes multiple second blade assemblies extending from the free end of the annular section and arranged around the annular section, the first blade assembly being disposed between each two adjacent second blade assemblies to overlap the second blade assemblies.

10. The combination fan propeller structure as claimed in claim 9, wherein the hub and the first and second blade assemblies are made of metal material.

* * * * *